US005414960A

United States Patent [19]

O'Donnell et al.

[11] Patent Number: 5,414,960

[45] Date of Patent: May 16, 1995

[54] WINDOW & DOOR SASH FRICTIONAL LOCKING DEVICE

[76] Inventors: Richard H. O'Donnell, R.R. #2, Minesing, Ontario, Canada, L0L 1Y0; Gaetano De Siato, 186 Wigwoss Drive, Woodbridge, Ontario, Canada

[21] Appl. No.: 194,670

[22] Filed: Feb. 4, 1994

[51] Int. Cl.[6] ..... E05D 15/22

[52] U.S. Cl. ..... 49/172; 49/181

[58] Field of Search ..... 49/177, 181, 176

[56] References Cited

U.S. PATENT DOCUMENTS

| | | | |
|---|---|---|---|
| 4,222,201 | 9/1980 | Yanessa . | |
| 4,337,597 | 7/1982 | Struckmeyer . | |
| 4,559,739 | 12/1985 | Buyer . | |
| 4,590,708 | 5/1986 | Campodonico . | |
| 4,610,108 | 9/1986 | Marshik | 49/181 |
| 4,718,194 | 1/1988 | Fitzgibbon et al. | 49/181 |
| 4,888,915 | 12/1989 | Goldenberg . | |
| 4,958,462 | 9/1990 | Cross | 49/181 |
| 5,027,557 | 7/1991 | May | 49/181 |
| 5,058,321 | 10/1991 | Harbom et al. . | |
| 5,127,192 | 7/1992 | Cross | 49/181 |
| 5,168,665 | 12/1992 | Goldenberg | 49/181 X |
| 5,237,775 | 8/1993 | Hardy | 49/181 |

FOREIGN PATENT DOCUMENTS 2202258 9/1988 United Kingdom .

*Primary Examiner*—Philip C. Kannan

*Attorney, Agent, or Firm*—Arne I. Fors; D. Doak Horne; Jeffrey T. Imai

[57] ABSTRACT

A pivoting and sliding device is provided which incorporates a unique cam and frictional locking assembly. Rotation of a cam in a sliding block, slidably mounted within a track, produces lateral expansion and normal biasing of the slide block to frictionally engage four sides of the slide block with respective opposing track surfaces. A vertical or horizontal window or door sash may be pivoted out of the plane of the frame about a pair of slide blocks rigidly locked to the frame.

4 Claims, 6 Drawing Sheets

WINDOW & DOOR SASH FRICTIONAL LOCKING DEVICE

BACKGROUND OF THE INVENTION

This invention relates to a pivoting and sliding device for slidable door or window assemblies mounted in a frame. More particularly, it relates to a pivoting and sliding device having a cam activated locking mechanism arranged for pivoting a slidable door or window out of the plane of the frame.

It is known in the prior art of slidable window sash and frame construction to have vertical and horizontal sliding windows adapted to be pivoted out of the frame when desired. For tasks such as cleaning the window from within the building in which the window is installed, a pivoting window must be securely arrested from sliding at the pivot point to prevent sagging or complete dislodging of the sash from the frame.

Pivot mechanisms have included moveable pins mounted on the edge of the sash which may be extended outwardly to engage holes in the frame about which the sash may be pivoted. U.S. Pat. No. 4,222,201 discloses a pivoting mechanism wherein a pair of spring biased pins are manually extended outward. Mating apertures in the tracks receive the pins, providing an axis of rotation. The sash may then be pivoted. After the window is pivoted back into the plane of the frame, the pins are retracted and secured in place by a screw to allow the sash to freely slide within the frame.

U.S. Pat. No. 5,058,321 discloses a mechanism wherein spring biased pivot pins are freed for selective extension into apertures formed in a frame by rotating said pins. The pins are retracted by rotation and secured in place by an arrangement of detents.

It is also known in the prior art to provide a pivoting arrangement which achieves automatic arresting of the sliding motion of a slider in a track in response to the commencement of the pivoting of the window sash. U.S. Pat. No. 4,610,108 discloses such a device which incorporates a generally U-shaped spring member within a block, wherein a pin or strut extending from a window sash is connected. A cam member is incorporated in the block member which is rotatably engageable with the U-shaped member to lock the block in position upon pivoting the window sash.

Although simple to operate, experience has shown that a pivot arrangement of this type may not develop adequate arresting strength and reliability.

SUMMARY OF THE INVENTION

In its broad aspect, a pivoting and locking device is disclosed for use with a window or door sash mounted for slidable travel in a pair of opposed tracks, said tracks each having an elongated base and a pair of spaced apart, opposed sidewalls extending perpendicular from said base, each said sidewalls having an inner shoulder spaced from and parallel to the base, said device comprising a slide block slidably mountable within each track having friction locking means in close abutment with the opposed track sidewalls and the track inner shoulders, cam means rotatably mounted in the slide block for laterally expanding the slide block for abutment of the friction locking means against the opposed track sidewalls and for concurrently biasing the friction locking means against the track inner shoulders, whereby the slide block is frictionally locked against slidable travel in the track, pivot means adapted to be secured to a window or door sash, and means for releasably mounting said pivot means in the slide block for actuation of the cam means.

Said friction locking means preferably comprises a textured surface formed on two sides of corners of the slide block and the underside of the cam means whereby the lateral expansion of the slide block against the opposed track sidewalls and biasing of the slide block against the track inner shoulders frictionally engage three sides of the slide block and the underside of the cam means against the opposed walls and base of the track.

The slide block preferably has a non-circular opening for receiving the cam means therein, the opening having an enlarged circular portion for receiving a circular flange formed on an end of the cam means, the opening enlarged circular portion and the cam means circular flange having opposed abutting surfaces. One of said surfaces has a pair of diametric recesses and other of said surfaces has a pair of diametric protruberances adapted to be received in the diametric recesses, whereby the slide block is urged away from the cam means upon rotation of the cam means in the slide block for displacement of the protruberances out of the recesses. The pivot means preferably have an extension and the cam means have an opening with a keyway for loosely receiving said pivot means extension. A locking tab is adapted for tight-fitting insertion into the cam means opening for tightly engaging the pivot means extension in the keyway whereby the cam means are rotatable with the pivot means.

BRIEF DESCRIPTION OF THE DRAWINGS

The pivoting and sliding device of the invention will now be described with reference to the accompanying drawings, in which.

DESCRIPTION OF THE PREFERRED EMBODIMENT

Figure 1:
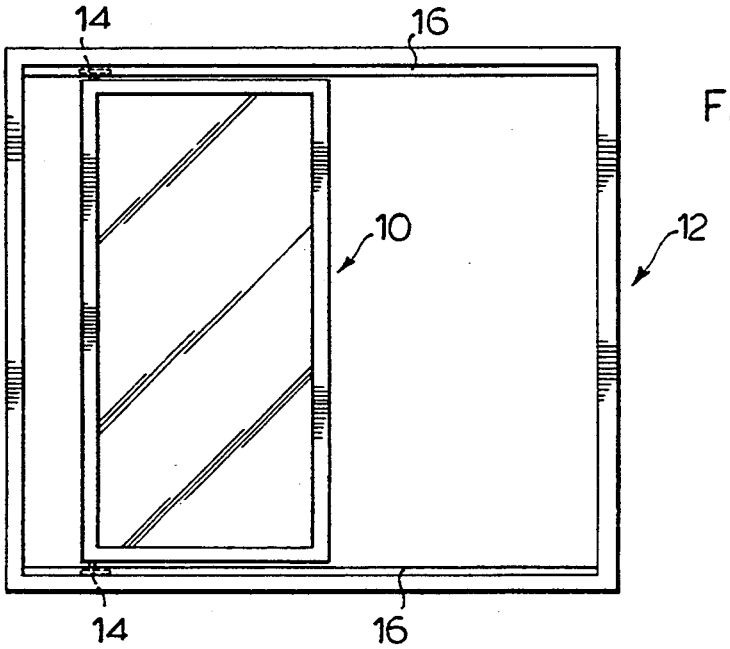
FIG. 1 is front elevation of a horizontally slidable sash and frame incorporating the device of the present invention.
Figure 4:
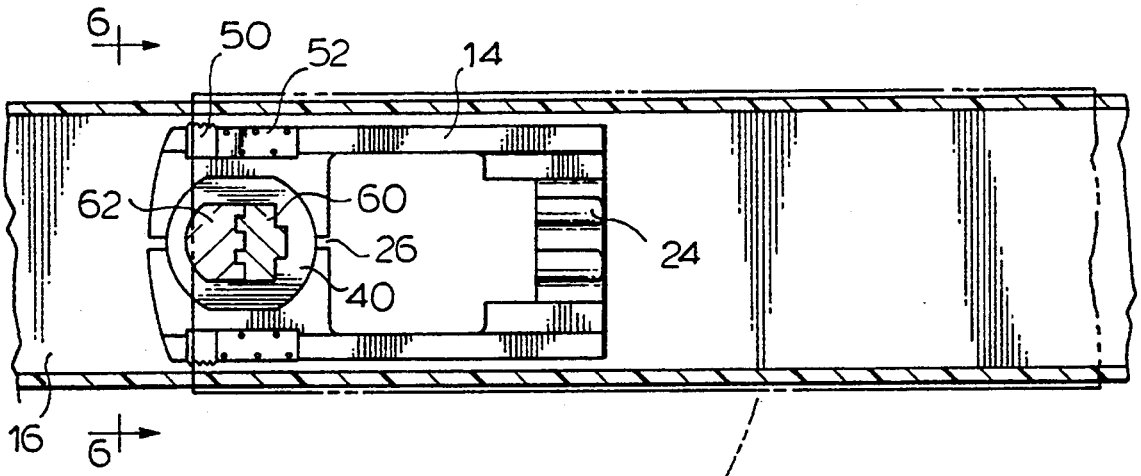
FIG. 4 is a horizontal cross section of the pivoting and sliding device of invention with the sash, depicted by ghost lines, in a normally planar position.

Referring now to FIG. 1 of the drawings, there is shown a horizontally slidable window or door sash designated by numeral 10 and a window or door frame 12. Slide blocks 14 mounted in parallel upper and lower tracks 16 provide normal sliding motion of the sash 10 in frame 12. The sash 10 is adapted to pivot out of the plane of the frame 12 about a vertical axis through the slide blocks 14. It must be pointed out at this juncture that the invention is not limited to horizontally sliding sashes, but also relates to vertical or any other conveniently oriented sash and frame combination.

Figure 8:
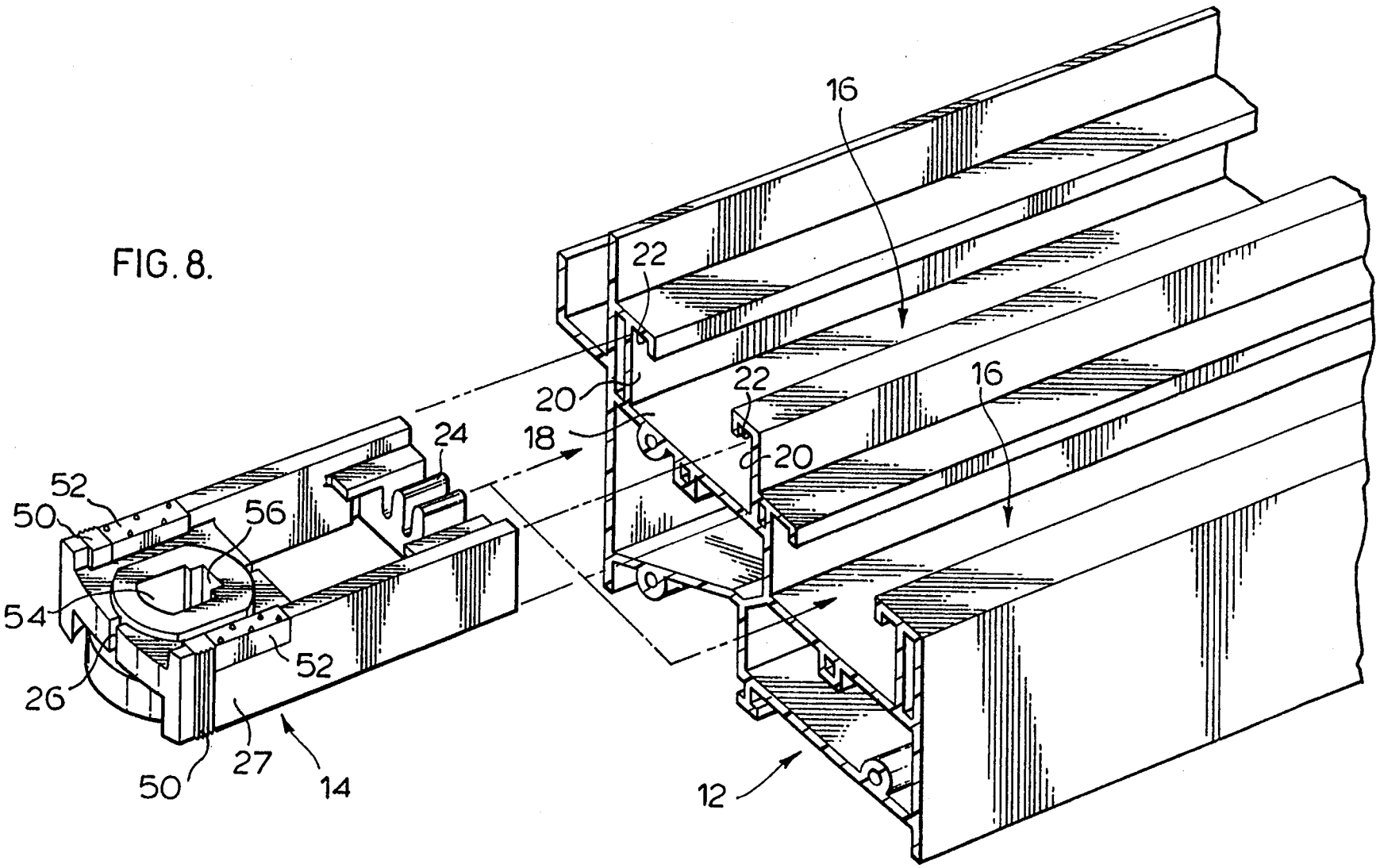
FIG. 8 is an exploded perspective view of the slide block and track.

Now referring to FIG. 8, a cross section of the frame 12 is shown having a pair of integral parallel tracks 16 formed therein into one of which a slide block 14 may be slidably mounted. The frame 12 may be formed of aluminum or plastic in an extrusion process or other suitable manufacturing method. Significant components of the track 16 include an elongated base 18 and a pair of opposed, spaced apart sidewalls 20 substantially parallel to one another and perpendicular to said elongated base 18. Each sidewall 20 has a perpendicular, inwardly facing shoulder 22, substantially parallel to the opposed elongated base 18. The function and importance of the track configuration as described herein will become evident as the description continues.

Figure 9:
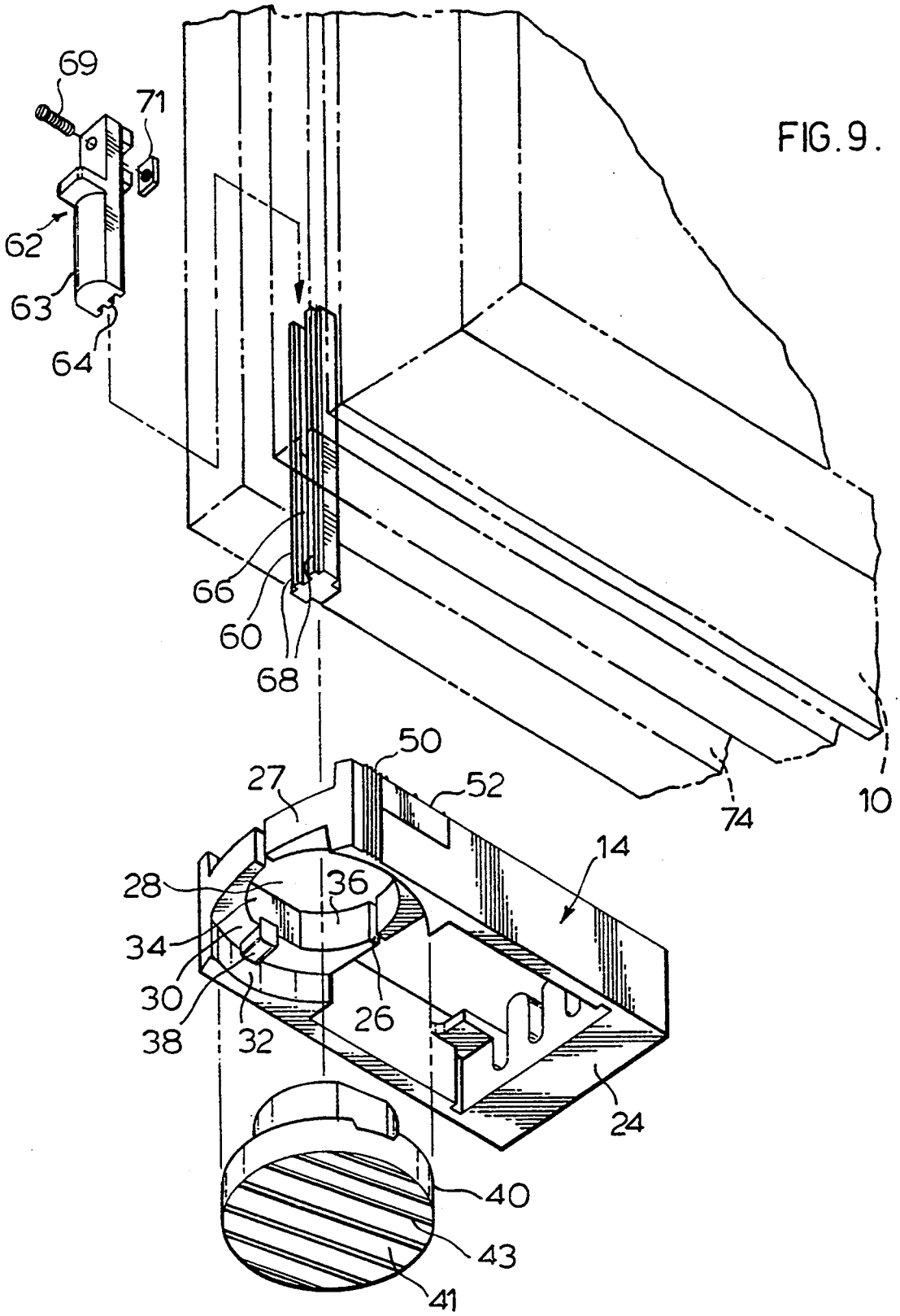
FIG. 9 is an exploded perspective view of the invention as seen from below, with a sash shown by ghost lines; and, FIG. 10 is an exploded perspective view of the invention as seen from above.

A detailed construction of the slide block 14 of the invention is shown in FIGS. 8 and 9, whereby the slide block 14 has outside dimensions contoured to fit within the track 16 as described above. Slide block 14 includes a hinge mechanism 24 and a longitudinal central slot 26 to allow end 27 of the slide block 14 to expand laterally outwardly. Slide block 14 preferably is manufactured from a resiliently yieldable and tough material such as nylon which, combined with a reduced or combination of reduced cross sections at hinge 24, allows flexing at said hinge 24. Slide block 14 also includes a vertical eccentric opening 28 at end 27 having a downwardly facing shoulder 30 depending into recess 32 below, which may be seen more clearly in FIG. 9. In the preferred embodiment, the eccentric opening 28 includes two diametrically opposing flats 34 in an otherwise cylindrical outline 36, these flats 34 being parallel to the sidewalls 20 of the track 16. A pair of downwardly depending diametrically opposed protruberances or cams 38 are spaced apart on the shoulder 34.

A cam mechanism 40 having two diametrically opposite flats 42 within a substantially cylindrical outline is adapted to pivotally and axially reciprocally fit in the non-circular, i.e. eccentric, opening 28 in the slide block 14. Circular flange 46 formed on the base of said cam mechanism, having a pair of diametric recesses 48 for receiving protruberances or cams 38, is adapted to fit in close abutment against shoulder 30 of slide block 14. The underside 41 of cam mechanism 40 has a plurality of elongated protrusions or ribs 43 extending across the planar underside 41. When the cam mechanism 40 is rotated, cam action produces both lateral expansion and vertical biasing of the slide block to lock the slide block in the track, to be described.

Slide block 14 includes friction engaging means 50 such as transverse ribs which slide in close abutment with track sidewalls 20 and friction engaging means 52 such as discrete teeth or protrusions which slide in close abutment with track inwardly facing shoulders 22. Friction engaging means 50 and 52 may be integrally formed with the slide block or inserted therein. Inserts 53 made from a hard, strong plastic or die cast zinc with ribs or small protrusions provide a strong friction engaging means. When slide block is expanded laterally and biased vertically, the friction engaging means are pressed tightly against the track side walls and shoulders, frictionally arresting movement of the slide block 14. It may be preferred to slightly bevel the upper corners 55 and 57 of the slide block 14 and inserts 53 to facilitate lateral expansion and upward vertical movement of the slide block.

Figure 10:
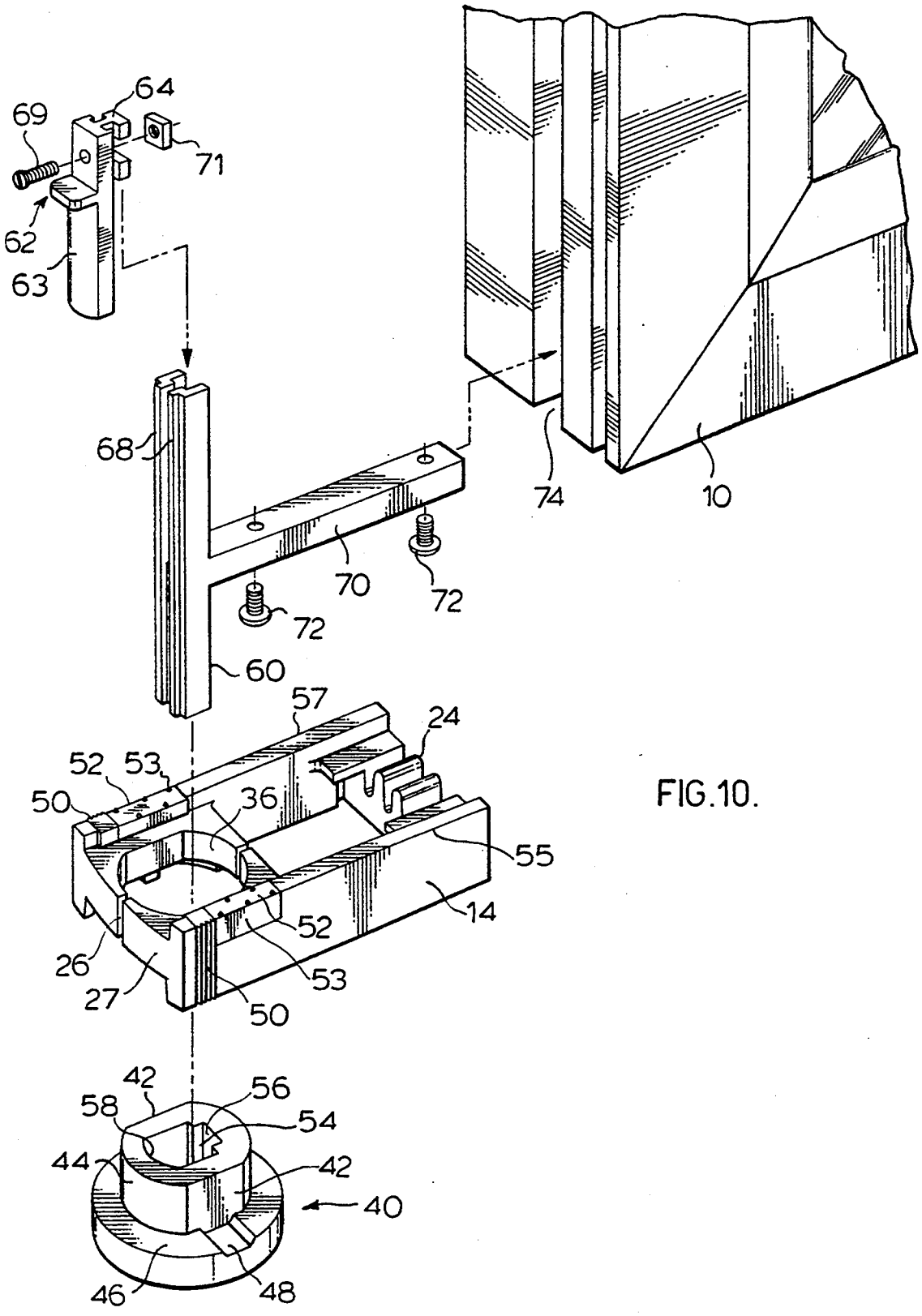

Referring now to FIG. 10, cam mechanism 40 includes an elongated opening 54, centrally located, having a rectangular keyway 56 at one side opposing an arcuate surface 58. An upwardly extending pivot means 60 for joining sash 10 to slide block 14 is mounted within the opening 54 of cam mechanism 40, adapted to fit in close abutment with the keyway 56. The upper extension of pivot means 60 has longitudinal ribs 68 with recess 66 configured to receive mating ribbed surface 64 of locking tab 62. The sliding of locking tab 62 downward, such that the locking tab lower extension 63 enters the opening 54 in close and mating abutment with the arcuate surface 58, tightly engages pivot means 60 in keyway 56 of opening 54. Locking tab 62 is secured to pivot means 60 by bolt 69 and lock nut 71. Horizontal arm 70 of the pivot means 60 is securely fastened to the underside of sash 10 in recess 74, such as with two screws 72.

Figure 5:
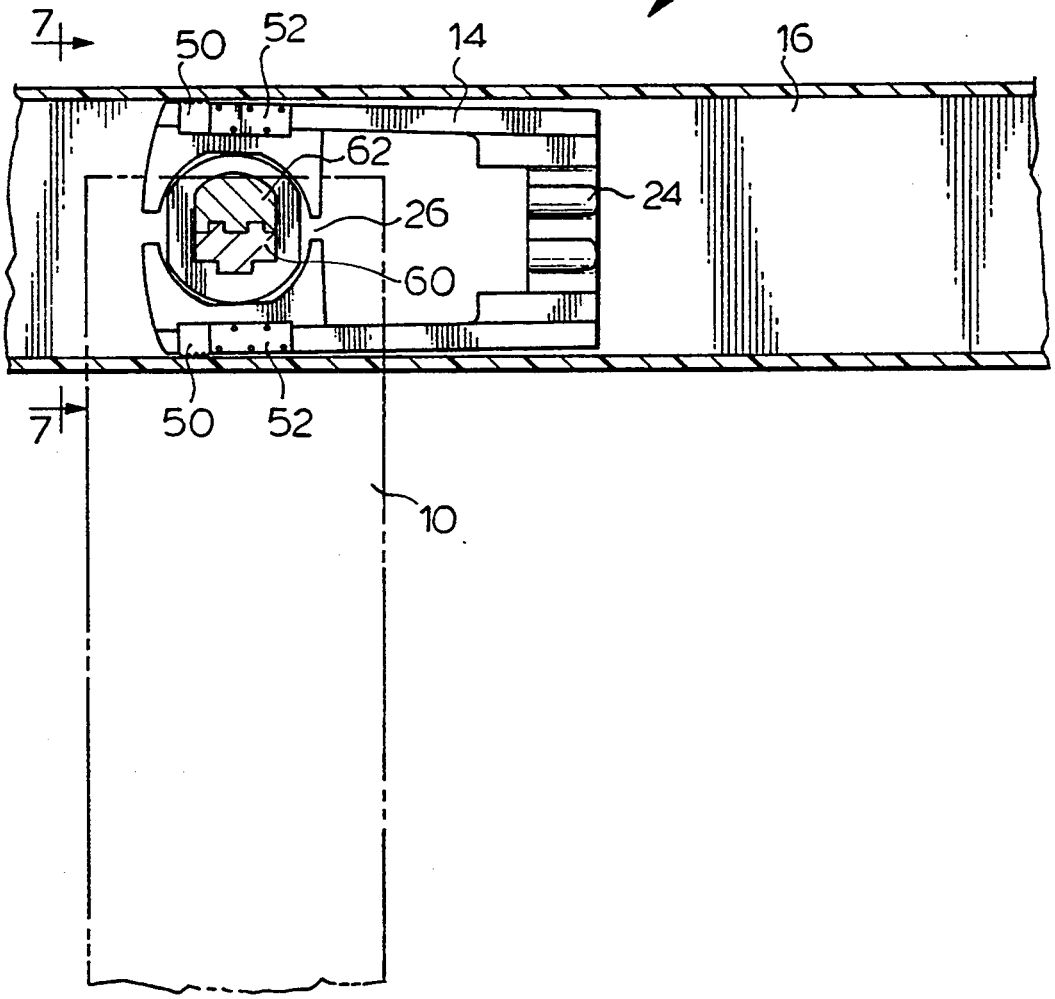
FIG. 5 is a horizontal cross section of the invention with the sash, depicted by ghost lines, pivoted 90° out of the plane of the frame, showing the expanded slide block and engaging friction means.
Figure 7:
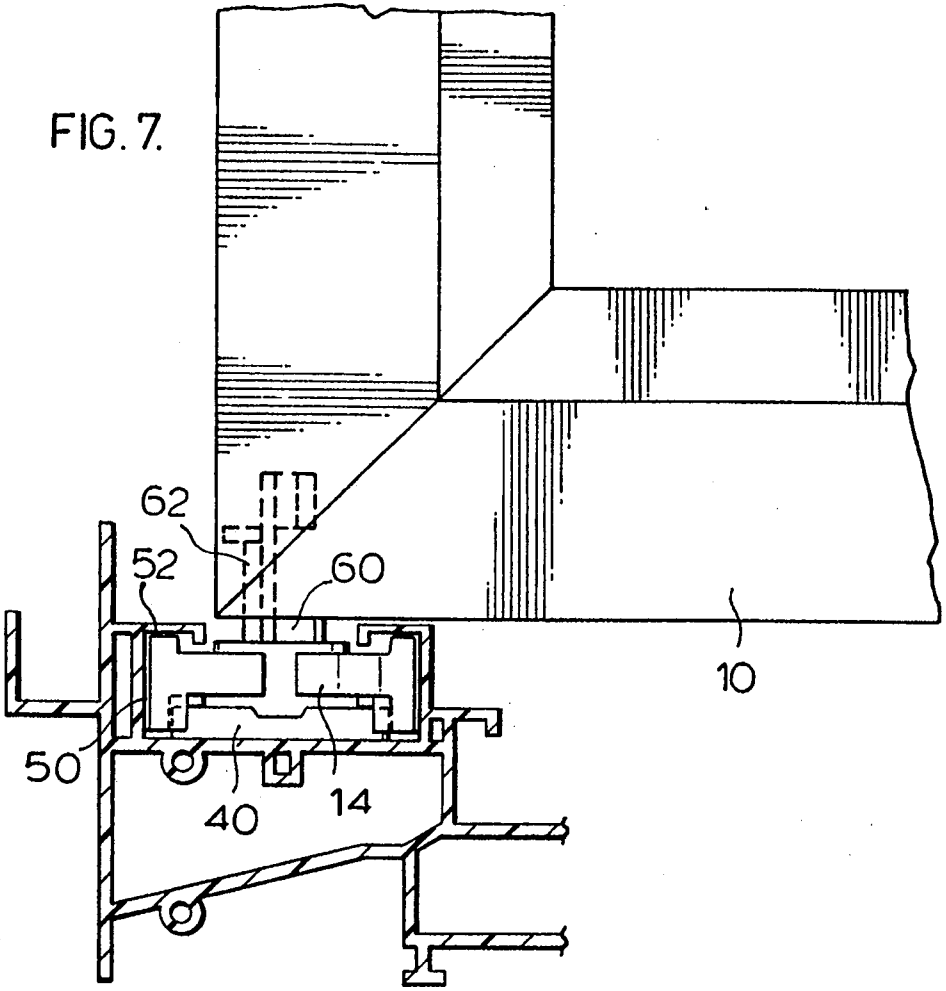
FIG. 7 is a vertical cross section taken through line 7—7 of FIG. 5 showing the slide block expanded and biased upwardly to engage friction means.
Figure 6:
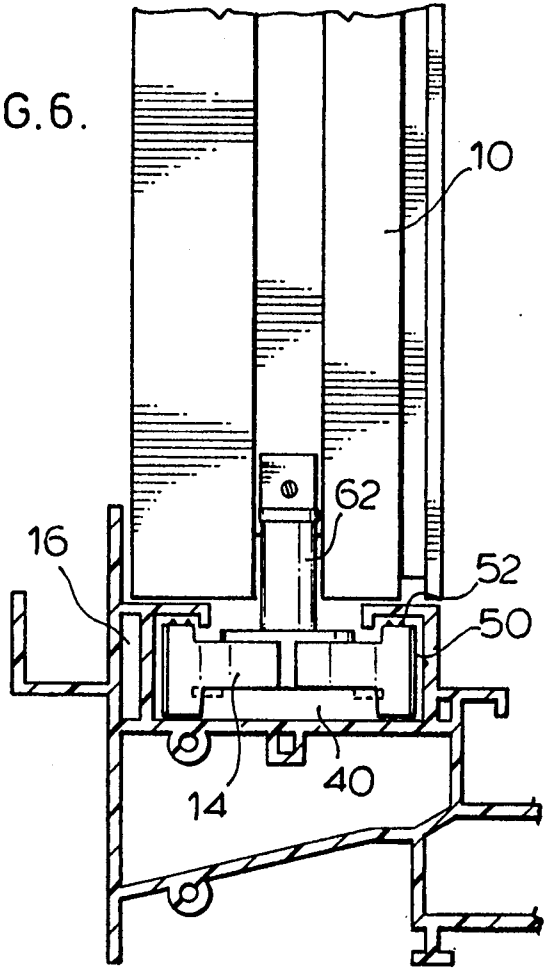
FIG. 6 is a vertical cross section taken through line 6—6 of FIG. 4.

In operation, window or door sash 10 freely slides horizontally or vertically in frame 16. If it is desired to pivot sash 10 out of the plane of the frame 16, such as for washing the rear side of the sash glass, the distal end of the sash is freed from the frame and pivoted outwardly to a position such as typified in FIGS. 5 and 7 by rotation of pivot means 60 and cam mechanisms 40 connected thereto of upper and lower slide blocks 14, end 27 of slide block 14 expands laterally outwardly by rotation of non-circular cam mechanism 40 in non-circular opening 28 and slide block 14 is biased away from track base 18 by axial displacement of cam mechanism 40 whereby transverse ribs 50 are pressed laterally outwardly against opposed track sidewalls 20 while teeth protrusions 52 are pressed against inwardly facing shoulders 22, to frictionally engage three sides of slide blocks 14 with the upper and lower frame tracks, while the ribs 43 on the underside 41 of cam mechanism frictionally engage track base 18. The sash thus is securely attached to the frame when pivoted out of the plane of the frame.

Figure 2:
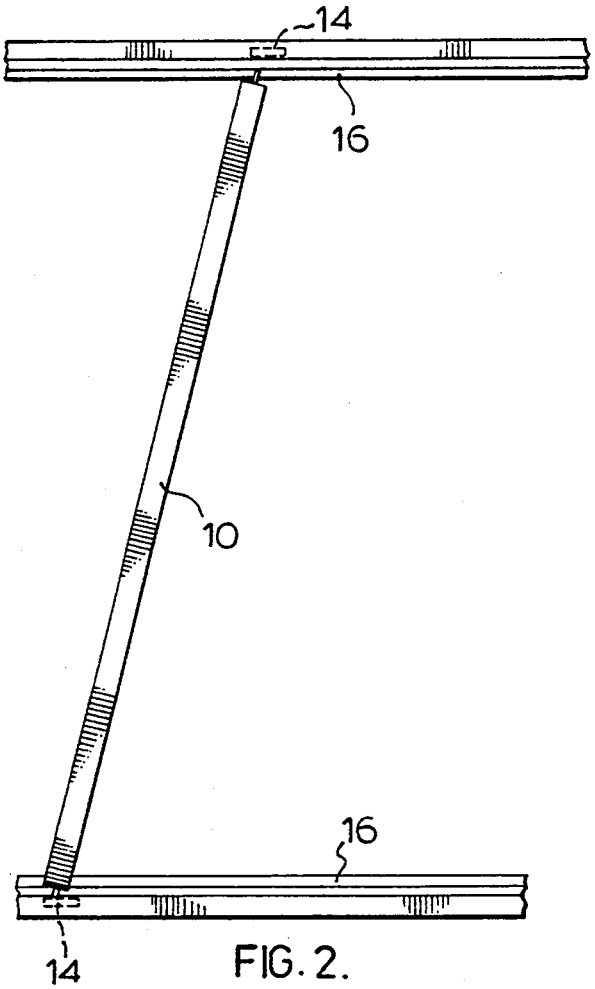
FIG. 2 is a front elevation of the sash and frame showing installation and removal of the sash.
Figure 3:
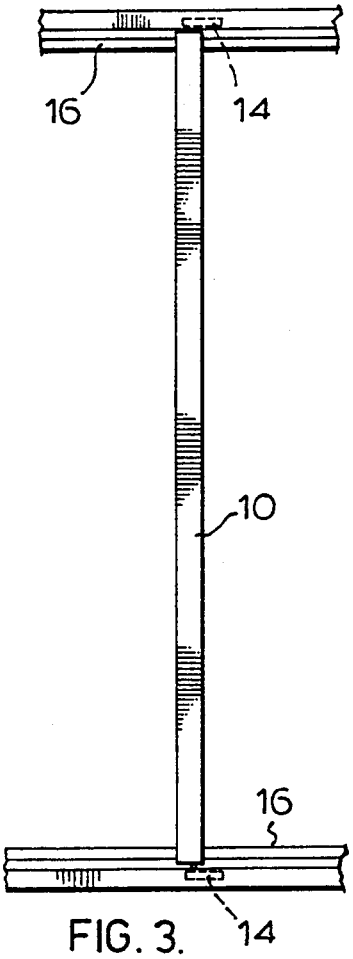
FIG. 3 is a partial front elevation of the sash and frame of FIG. 1 showing the sash pivoted perpendicular to the frame.

With reference to FIGS. 2 and 3, sash installation and removal are facilitated by the device of the invention. Removal of locking tab 62, shown in FIGS. 9 and 10, loosens pivot means 60 in cam mechanisms 40 so that the cam mechanisms free the friction engaging means 50 and 52, such that the sash can be tilted when perpendicular to frame 16 to the position shown in FIG. 2, for removal from the frame. The procedure is reversed for installation of a sash, with locking tab 62 inserted once the sash is positioned perpendicular to tracks 16 of frame 12.

The present invention provides a number of important advantages. Window and door sash can be pivoted out of the plane of a frame, such as for washing, and safely restrained in the frame. If desired, the sash can be easily removed from the frame by removal of a locking tab. The connecting portion of the pivot means for joining the sash to the sliding mechanism is hidden from access from intruders and can be detached from the sash only when the sash is removed from the frame. The pivoting and sliding device is simple in design and reliable and trouble-free in operation.

It will be understood that various modifications can be made without departing from the essential features of the invention as particularly disclosed or from the scope and purview of the appended claims.

We claim:

1. A pivoting and locking device for use with a window or door sash mounted for slidable travel in a pair of opposed tracks, said tracks each having an elongated base and a pair or spaced apart, opposed sidewalls extending perpendicular from said base, each said sidewalls having an inner shoulder spaced from and parallel to the base, comprising, in combination:

a slide block slidably mountable within each track having friction locking means in close abutment with the opposed track sidewalls and the track inner shoulders; cam means having a bottom surface with friction locking means rotatably mounted in the slide block for concurrently laterally expanding the slide block for frictional abutment of the slide block friction locking means against the opposed track sidewalls and the track inner shoulders and for axially biasing the cam bottom friction locking means against the track base whereby the slide block is frictionally locked against slidable travel in the track by rotation of the cam means; pivot means adapted to be secured to a window or door sash; and means for releasably mounting said pivot means in the cam means for rotation of the cam means upon pivoting the window or door sash out of the plane of the frame.

2. A pivoting and locking device as claimed in claim 1, wherein said friction locking means comprise transverse ribs formed on corners or the slide block adjacent the track sidewalls, protrusions formed on corners of the slide block adjacent the track inner shoulders and protrusions formed on the cam bottom surface adjacent the track base whereby the lateral expansion of the slide block against the opposed track sidewalls and concurrent biasing of the slide block against the track inner shoulders and the track base simultaneously frictionally engages three sides of the slide block and the bottom the cam with the track.

3. A pivoting and locking device as claimed in claim 2, wherein the slide block has a non-circular opening for receiving the cam means therein, the opening having an enlarged circular portion for receiving a circular flange formed on an end of the cam means, the opening enlarged circular portion and the cam means circular flange having opposed abutting surfaces, one of said surfaces having a pair of diametric recesses and other of said surfaces having a pair of diametric protruberances adapted to be received in the diametric recesses, whereby the slide block is urged away from the cam means upon rotation of the cam means in the slide block for axial displacement of the protruberances out of the recesses.

4. A pivoting and locking device as claimed in claim 3, wherein the pivot means have an extension and the cam means have an opening with a keyway for loosely receiving said pivot means extension, and a locking tab for tight-fitting insertion into said cam means opening for tightly engaging the pivot means extension in the keyway whereby the cam means are rotatable with the pivot means.

* * * * *